US008711048B2

(12) United States Patent
Gemeny et al.

(10) Patent No.: US 8,711,048 B2
(45) Date of Patent: Apr. 29, 2014

(54) DAMAGE RESISTANT ANTENNA

(75) Inventors: Steven E. Gemeny, Finksburg, MD (US); Eugene Yi-chien Lee, Columbus, OH (US); Gary W. Bruce, Severna Park, MD (US)

(73) Assignee: Syntonics, LLC, Columbia, MD (US)

( * ) Notice: Subject to any disclaimer, the term of this patent is extended or adjusted under 35 U.S.C. 154(b) by 356 days.

(21) Appl. No.: 13/150,582

(22) Filed: Jun. 1, 2011

(65) Prior Publication Data

US 2012/0019422 A1 Jan. 26, 2012

Related U.S. Application Data

(60) Provisional application No. 61/350,225, filed on Jun. 1, 2010.

(51) Int. Cl.
*H01Q 9/00* (2006.01)

(52) U.S. Cl.
USPC ..... 343/749

(58) Field of Classification Search
USPC ..... 343/749, 702, 880, 900
See application file for complete search history.

(56) References Cited

U.S. PATENT DOCUMENTS

| | | | | |
|---|---|---|---|---|
| 4,663,632 | A * | 5/1987 | Budrow et al. | 343/714 |
| 5,945,953 | A * | 8/1999 | Tsuda et al. | 343/702 |
| 6,243,051 | B1 | 6/2001 | Vanstrum et al. | |
| 6,310,578 | B1 * | 10/2001 | Ying | 343/702 |
| 6,369,764 | B1 * | 4/2002 | Ishikawa | 343/702 |
| 6,958,951 | B2 | 10/2005 | Duven | |
| 6,975,178 | B1 | 12/2005 | Kessler et al. | |
| 7,019,708 | B2 | 3/2006 | Regala | |
| 7,199,763 | B2 | 4/2007 | Bryan, Jr. et al. | |
| 7,239,291 | B2 | 7/2007 | Walton | |
| 7,317,361 | B2 | 1/2008 | Duven et al. | |
| 7,385,562 | B2 | 6/2008 | Stoyanov et al. | |
| 7,487,013 | B2 | 2/2009 | Miklos | |
| 7,545,332 | B2 * | 6/2009 | Kim et al. | 343/702 |
| 7,561,109 | B2 | 7/2009 | Walton et al. | |
| 7,567,215 | B1 | 7/2009 | All et al. | |
| 7,576,696 | B2 | 8/2009 | Walton et al. | |
| 7,595,762 | B2 | 9/2009 | Mansour | |
| 7,623,075 | B2 | 11/2009 | Apostolos | |
| 7,629,935 | B2 | 12/2009 | Mansour et al. | |
| 2007/0132657 | A1 | 6/2007 | Walton et al. | |

* cited by examiner

*Primary Examiner* — Seung Lee

(74) *Attorney, Agent, or Firm* — Whiteford, Taylor & Preston LLP; Gregory M. Stone

(57) ABSTRACT

The invention provides a damage resistant antenna using a super-elastic flexible metallic material to form antenna radiating structures with a high damage threshold. The invention accounts for the electro-magnetic properties of the super-elastic flexible metallic material in the design of the shape and dimensions needed to form antenna radiating structures with consistent performance after repeated deploy, stow, and transport cycling of the antenna.

29 Claims, 3 Drawing Sheets

DAMAGE RESISTANT ANTENNA

CROSS REFERENCE TO RELATED APPLICATION

This application is based upon and claims benefit of co-owned U.S. Provisional Patent Application Ser. No. 61/350,225 entitled "Damage Resistant Antenna", filed with the U.S. Patent and Trademark Office on Jun. 1, 2010 by the inventors herein, the specification of which is incorporated herein by reference.

BACKGROUND

1. Field of the Invention

The present invention relates generally to the design and operation of antennae, and particularly to antennae that can be folded and compactly stored.

2. Description of the Background

Antennas have been fabricated of many materials in numerous forms for nearly a century. Fundamental to all antennas is the use of electrically conductive material to form the electrical fields needed to radiate electromagnetic energy as a propagating radio wave. Materials that are good electrical conductors are metallic, e.g. Gold, Silver, Copper, Aluminum, or they are metallic alloys, e.g. Brass, Bronze, Stainless Steel, etc. The nature of most metals and metal alloys is their tendency to be rigid, brittle, or malleable such that they do not return to the original form after being stressed as tends to occur during transport and repositioning. This behavior causes portable or transportable antenna designs to be highly susceptible to damage resulting from shock, impact, dropping, or other mishandling during transport and deployment.

The shape and form of electrically conductive components used to form antennas is an integral part of the antenna design such that variations to this shape, caused by stress or other damage, alter the performance in a significant and unpredictable manner. Once damaged, antennas rarely, if ever, perform as intended.

Metals used for antennas are generally protected from damage due to environmental effects, such as corrosion and rust, with protective coatings like paint. Generally, the metallic components are not protected from physical damage or are segmented into smaller sections with joints that can fail, necessitating component replacement. In some situations, conductive wires comprised of a plurality of small strands of metallic conductors grouped together via weaving, wrapping, or over coating in a flexible non-conducting material are used to mitigate the damaging effects of bending. However, the metallic conductors, if exposed to excessive flexure or small radius bending will deform and not return to their initial shape.

In portable or transportable applications, the metallic conductors used to form the radiating structures of antennas are damage prone. Once exposed to excessive flexure, physical blows, or small radius bending, such as occur during transportation, handling, and deployment, these conductive elements deform and alter the performance of the antenna in an unacceptable manor. Field expedient repairs and reforming of damaged components rarely, if ever, yields a serviceable solution. More likely, the bending of the antenna component results in a localized hardening of the component at the molecular level known as "work hardening". Once bent and hardened into the wrong position, re-bending to the proper position typically results in a fracture and total failure of the component.

SUMMARY

Accordingly, it is an object of the present invention to provide a bendable antenna that avoids the disadvantages of the prior art.

It is an object of the present invention to provide an improved antenna assembly.

It is an object of the present invention to provide a damage resistant antenna. A related object of the present invention is to provide an antenna made of super-elastic materials.

Another object of the present invention is to provide a damage resistant antenna using conductive material(s) capable of forming antenna radiating structures having a high damage threshold. A related object of the present invention is to produce an antenna with repeatable performance after repeated deploy, stow, and transport cycling.

Another object of the present invention is to provide a damage resistant antenna that is economical to produce and uncomplicated in configuration. A related object of the present invention is to provide a damage resistant antenna that is simple to deploy and simple to use.

Some of the goals of the present invention are to: A) identify conductive material(s) capable of forming antenna radiating structures with a high damage threshold, such that the antenna can be formed, reformed, deformed, and returned to the intended geometry necessary to produce an antenna with repeatable performance after repeated deploy, stow, and transport cycling; B) account for the electro-magnetic properties of the identified materials in the design of the shape and dimensions needed to form antenna radiating structures with repeatable performance after repeated deploy, stow, and transport cycling; C) create fabrication methods and techniques needed to manufacture antenna radiating structures using these materials in order to meet design performance specifications after repeated deploy, stow, and transport cycling of the antenna.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF EXEMPLARY EMBODIMENTS

Figure 1:
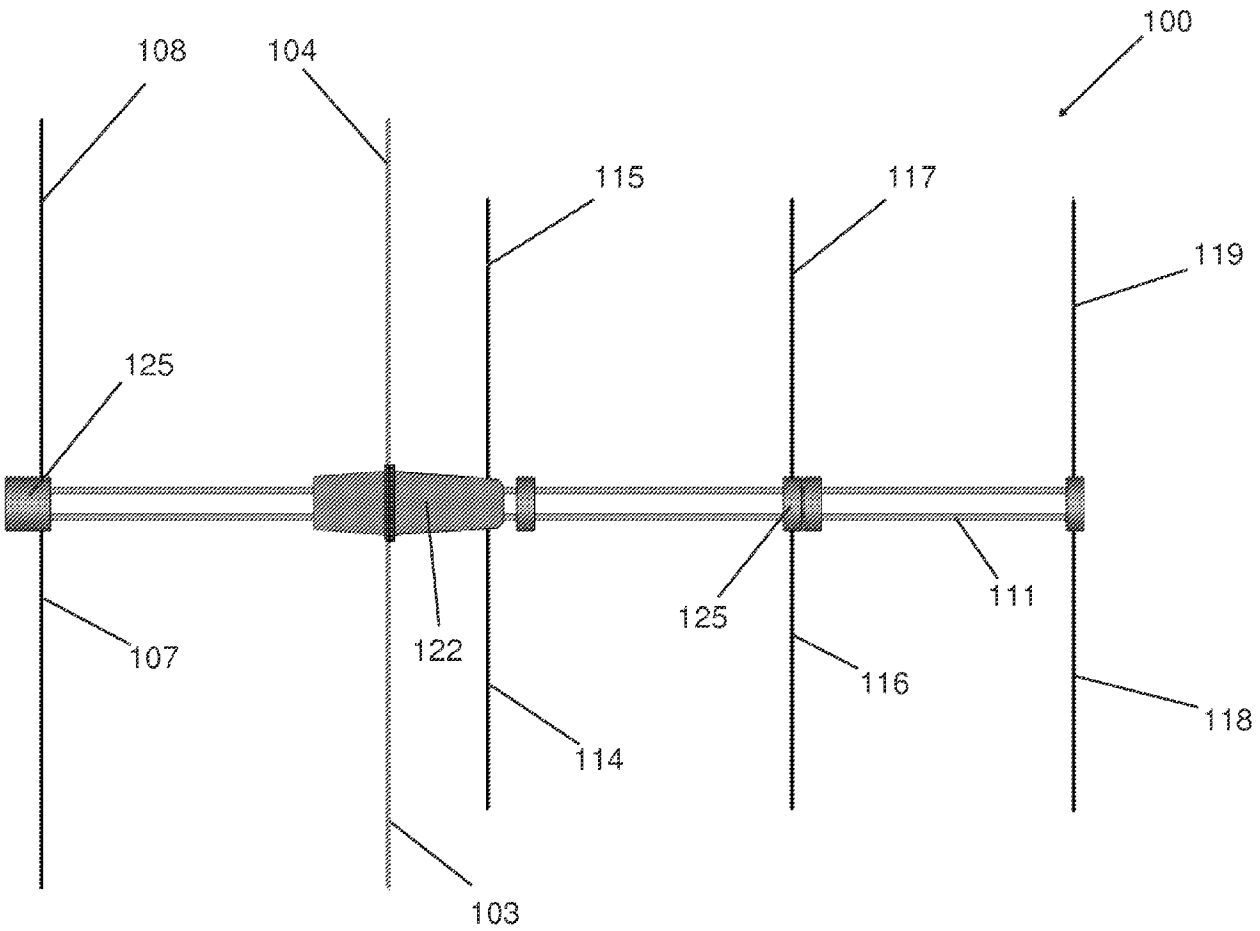
FIG. 1 is a general schematic illustration of an antenna layout according to one embodiment of the present invention.

The invention summarized above and defined by the enumerated claims may be better understood by referring to the following description, which should be read in conjunction with the accompanying drawings. This description of an embodiment, set out below to enable one to build and use an implementation of the invention, is not intended to limit the invention, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Super-Elastic Metallic alloys are known to have lower electrical conductivity than those materials typically employed by antenna designers. Reduced electrical conductivity can introduce excessive loss of energy in antenna components and therefore, is avoided by antenna designers. It is for this reason that super-elastic metallic alloys have been overlooked for use as materials for radiating structures in antennas. In the present invention, the electrical conductivity, along with the magnetic permeability and the electric permittivity of the super-elastic alloys, are included in the design process to define the necessary geometry in order to form efficient radiating components forming the antenna. The result is an antenna geometry that is optimized for the particular super-elastic metallic alloy being used. In this way, the super-elastic nature of the metallic alloy can be used to enhance the damage tolerance of the antenna components without significantly degrading the electrical performance due to reduced electrical conductivity.

Antennas can be comprised of numerous radiating components arranged relative to each other in complex geometries so as to confine or direct the individual energies in order to form specific, combined patterns of Radio wave energy. In some situations, these radiating structures are directly "driving" with Radio Frequency energy, in other cases the radiating components receive and re-radiate the energy by a process referred to as parasitic excitation. The geometries and the placements of both directly driving and parasitically excited radiating elements can be designed to take into account the electromagnetic properties of the super-elastic metallic alloys from which they are formed, gaining the same high damage threshold result for the complete antenna structure.

The same properties that cause the super-elastic alloys to be attractive for use as damage resistant antenna components present unique challenges for the designers in other areas of antenna construction, as well. The chosen alloys are exceedingly difficult to connect to using conventional methods, like soldering, common to the antenna fabrication trade. Any method of connection that relies on the application of a different alloy, such as any of the solders used in the electronics industry, fails due to the dissimilar physical properties of the two alloys.

The physical deformations that can be tolerated by the super-elastic alloys exceed the mechanical tolerance of the solders available resulting in joint failure. In instances where high temperatures are necessary to melt a particular solder material, such temperatures cause changes in the super-elastic alloy at the molecular level, altering or eliminating the super elastic property. Further, the flexibility of the alloy that enables its high damage threshold causes crimp connections, which are typically used in antenna fabrication, to be unreliable as a connection means.

To overcome some difficulties in making reliable electrical connections to super-elastic metallic alloys the present invention discloses a technique that uses compression of a malleable conductor component sandwiching the super-elastic component. This malleable component is held in intimate contact with the super-elastic component by mechanical means and provides a solder point for electrical connection to the super-elastic alloy component.

Referring to the drawings, FIG. 1 shows a general schematic illustration of an antenna layout according to one embodiment of the present invention. The antenna, indicated generally as 100, comprises a plurality of elements including driving elements 103, 104 and reflecting elements 107, 108 mounted on a shaft 111. Preferably, the plurality of elements will be mounted substantially perpendicular to the shaft 111. The antenna 100 may also include a plurality of directing elements, such as 114, 115, 116, 117, 118, and 119. The driving elements 103, 104 are typically operably attached to an electronics core 122, which contains appropriate electronic components for tuning the antenna 100. In some embodiments, the antenna of the present invention may be tuned to a frequency range of 200-400 MHz. The reflecting elements 107, 108 and the directing elements 114, 115, 116, 117, 118, 119 may be connected to hubs 125. In some embodiments, the shaft 111 may comprise two or more rigid or semi-rigid rods. In some embodiments, the hubs 125 may be moveable along the shaft 111 in order to assume an appropriate geometry between the various elements for tuning and aiming the antenna.

Figure 2:
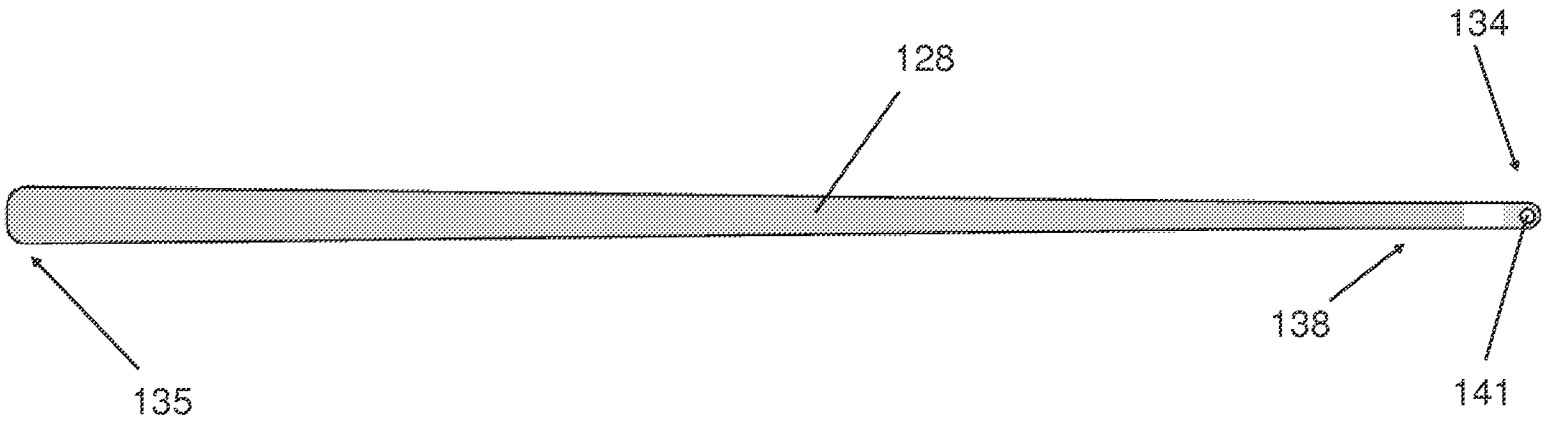
FIG. 2 is a plan view of a single antenna element according to an embodiment of the present invention.
Figure 3:
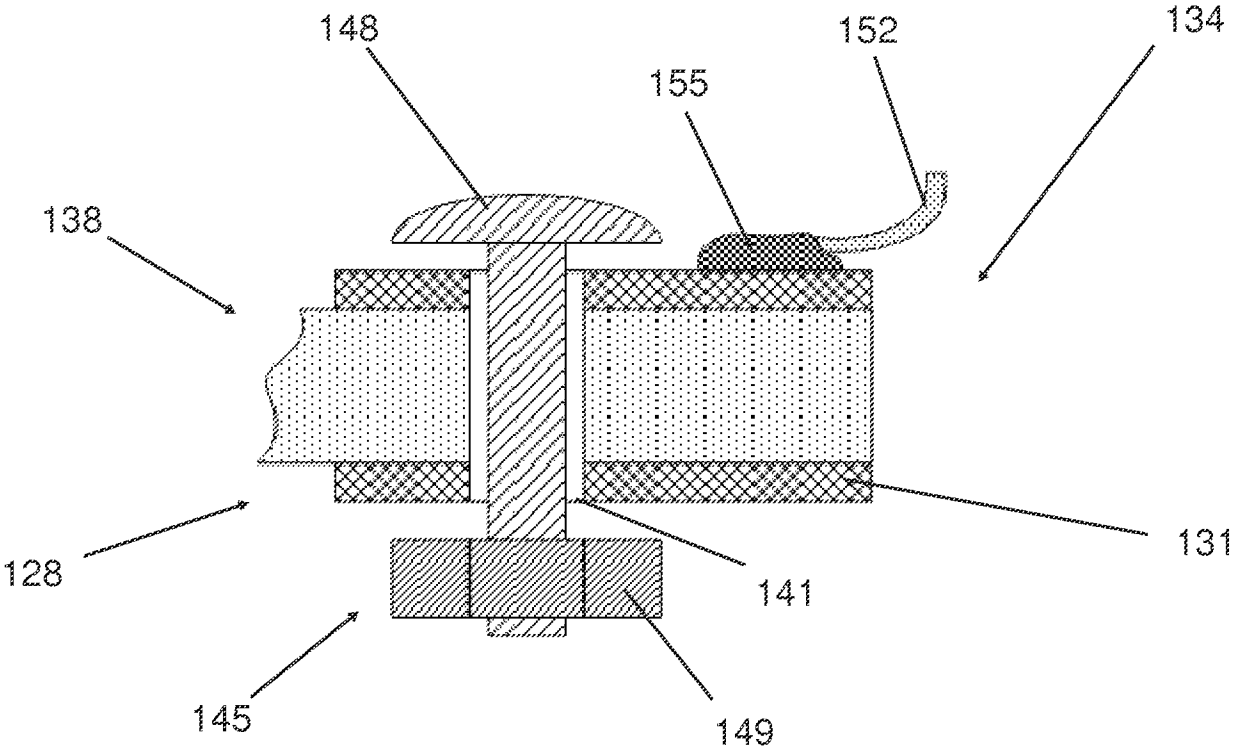
FIG. 3 is a cross-sectional view of an attachment mechanism for an antenna element according to an embodiment of the present invention.

FIG. 2 shows a typical antenna element 128 according to an embodiment of the present invention. Antenna element 128 comprises a substantially flat band, generally made of super-elastic alloy with an electrically conductive malleable material 131 on one or both sides, as shown in FIG. 3. In a preferred embodiment, the dimension of the overall length of antenna element 128 is significantly longer than the dimension of the width of said antenna element 128. The ends 134, 135 of antenna element 128 may be rounded or flat with rounded edges. Preferably, the antenna element 128 comprises a super-elastic alloy formed into a tapered length. The width of the antenna element 128 is generally wider at end 135 than at end 134. A portion 138 of end 134 may be left untapered. As shown in FIG. 3, the conductive malleable material 131 is applied to only an end 134 of the antenna element 128. The geometry of the antenna element 128 is determined by antenna performance requirements accounting for electromagnetic properties of the material. Some of the properties considered include electrical conductivity of the super-elastic alloy, electrical permittivity of the super-elastic alloy, and magnetic permeability of the super-elastic alloy. Those properties should be considered when determining the length, width, thickness, and taper of the antenna element 128. A hole or aperture 141 may be formed in end 134 of antenna element 128 for attachment of the antenna element 128 to the electronics core 122 or the hub(s) 125.

FIG. 3 shows an example of a mechanism 145 for attaching the antenna element 128 to the electronics core 122 or the hub(s) 125. The attachment method may include a mechanical compression using a bolt 148 and nut 149, a rivet, or other appropriate compression means. The antenna element 128 may be connected using solder 155 or other appropriate means to the electronics core 122 of the antenna 100 by a wire connection 152 that is connected to the conductive malleable material 131 on the antenna element 128.

Alternate embodiments of this invention could include geometric variations of the Super-Elastic Metallic alloys such as round or other cross section, variations in thickness or diameter, variations in width other than linear taper including curved or sinusoidal. Variations in the attachment arrangement could include screw & nut, rivet, or other forms of physically deforming structures that creates compressive force on the layer(s) of malleable material to assure continued intimate contact with the Super-Elastic Metallic alloy.

Preferably, an antenna of the present invention uses rugged super-elastic metal elements on an engineering polymer frame. Some of the RF specifications for the antenna may include a frequency band of 200-400 MHz, gain of approximately 5-8 dBic, impedance of 50 ohms, and a power rating of 200 W, continuous.

This invention improves on the prior art by: A) using a super-elastic flexible metallic material to form antenna radiating structures with a high damage threshold such that the antenna can be formed, reformed, deformed, bent, or folded, yet return to the intended geometry necessary to produce an antenna with consistent performance after repeated deploy, stow, and transport cycling; B) accounts for the electro-magnetic properties of the super-elastic flexible metallic material in the design of the shape and dimensions needed to form antenna radiating structures with repeatable performance after repeated deploy, stow, and transport cycling; C) uses special fabrication methods and techniques to manufacture antenna radiating structures from super-elastic metallic material in order to meet design performance specifications after repeated deploy, stow, and transport cycling of the antenna.

The invention has been described with references to specific embodiments. While particular values, relationships, materials and steps have been set forth for purposes of describing concepts of the invention, it will be appreciated by persons skilled in the art that numerous variations and/or modifications may be made to the invention as shown in the disclosed embodiments without departing from the spirit or scope of the basic concepts and operating principles of the invention as broadly described. It should be recognized that, in the light of the above teachings, those skilled in the art could modify those specifics without departing from the invention taught herein. Having now fully set forth certain embodiments and modifications of the concept underlying the present invention, various other embodiments as well as potential variations and modifications of the embodiments shown and described herein will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention might be practiced otherwise than as specifically set forth herein. Consequently, the present embodiments are to be considered in all respects as illustrative and not restrictive.

What is claimed is:

1. An antenna, comprising:

a shaft; and a plurality of antenna elements mounted on the shaft, said antenna elements having an elongate body with a length dimension significantly longer than a width dimension, wherein said plurality of antenna elements comprise a super-elastic material and an electrically conductive, malleable material on at least a portion of the elongate body.

2. The antenna of claim 1, wherein said plurality of antenna elements comprises driving elements and reflecting elements.

3. The antenna of claim 2, said plurality of antenna elements further comprises directing elements.

4. The antenna of claim 1, said shaft comprising at least two rods.

5. The antenna of claim 1, said shaft comprising one or more rods selected from the group consisting of:

rigid rods;

semi-rigid rods; and combinations of the above.

6. The antenna of claim 1, further comprising at least one hub.

7. The antenna of claim 6, wherein at least a portion of said plurality of antenna elements is attached to said at least one hub.

8. The antenna of claim 6, wherein said at least one hub is slidably connected to said shaft.

9. The antenna of claim 1, further comprising at least one electronics core.

10. The antenna of claim 9, wherein at least a portion of said plurality of antenna elements is operably attached to said at least one electronics core.

11. The antenna of claim 1, wherein said plurality of antenna elements is mounted to said shaft using compression of said malleable material.

12. The antenna of claim 1, said plurality of antenna elements comprising an aperture through the malleable material and elongate body.

13. The antenna of claim 12, wherein said plurality of antenna elements is mounted to said shaft using a nut and bolt or rivet to provide mechanical compression of said malleable material.

14. A method of attaching an antenna element to an electronics core of an antenna, wherein said antenna element comprises a super-elastic material, said method comprising:

covering at least a portion of the antenna element with an electrically conductive, malleable material;

compressing the malleable material using a mechanical connector to mount the antenna element on the electronics core; and electrically connecting the malleable material to the electronics core.

15. The method of claim 14, wherein said malleable material covers at least a portion of two sides of a flat antenna element, said method further comprising:

sandwiching said super-elastic material between two sides of said malleable material.

16. The method of claim 14, wherein said mechanical connector is a nut and bolt or rivet.

17. An antenna, comprising:

a shaft; and a plurality of antenna elements mounted on the shaft, said antenna elements having an elongate body with a length dimension significantly longer than a width dimension, and said antenna elements further comprising at least one of an antenna driving element configured to direct radiation towards a plurality of directing elements, and an antenna reflecting element configured to reflect radiation from said antenna driving element and towards said directing elements;

wherein said plurality of antenna elements comprise a super-elastic metallic alloy.

18. The antenna of claim 17, said plurality of antenna elements further comprising a plurality of directing elements.

19. The antenna of claim 17, said shaft comprising at least two rods.

20. The antenna of claim 17, said shaft comprising one or more rods selected from the group consisting of rigid rods, semi-rigid rods, and combinations thereof.

21. The antenna of claim 17, further comprising at least one hub.

22. The antenna of claim 21, wherein at least a portion of each of said antenna elements is attached to one of said at least one hub.

23. The antenna of claim 21, wherein said at least one hub is slidably connected to said shaft.

24. The antenna of claim 17, further comprising at least one electronics core.

25. The antenna of claim 24, wherein at least a portion of said plurality of antenna elements is operably attached to said at least one electronics core.

26. The antenna of claim 17, wherein said plurality of antenna elements comprises an electrically conductive, malleable material on at least a portion of the elongate body.

27. The antenna of claim 26, wherein said plurality of antenna elements is mounted to said shaft using compression of said malleable material.

28. The antenna of claim 26, said plurality of antenna elements comprising an aperture through the malleable material and elongate body.

29. The antenna of claim 28, wherein said plurality of antenna elements is mounted to said shaft using a nut and bolt or rivet to provide mechanical compression of said malleable material.

* * * * *